US005865133A

United States Patent [19]

Herbach et al.

[11] Patent Number: 5,865,133

[45] Date of Patent: Feb. 2, 1999

[54] PROCESS FOR EMBROIDERING OVERSIZED PATTERNS

[75] Inventors: Mathias Herbach, Pfinztal; Helmar Holl; Rolf Kessler, both of Karlsruhe, all of Germany

[73] Assignee: G.M. PFAFF Aktiengesellschaft, Kaiserslautern, Germany

[21] Appl. No.: 27,706

[22] Filed: Feb. 23, 1998

[30] Foreign Application Priority Data

Feb. 25, 1997 [DE] Germany ..... 197 07 527.4
Dec. 18, 1997 [DE] Germany ..... 197 56 351.1

[51] Int. Cl.[6] ..... D05B 21/00

[52] U.S. Cl. ..... 112/475.19; 112/102.5

[58] Field of Search ..... 112/102.5, 470.06, 112/103, 470.01, 475.19, 475.18, 475.04, 475.05

[56] References Cited

U.S. PATENT DOCUMENTS 5,553,559 9/1996 Inoue et al. ..... 112/102.5
5,771,826 6/1998 Hirata ..... 112/102.5

FOREIGN PATENT DOCUMENTS 31 34 028 C2 3/1983 Germany .

*Primary Examiner*—Peter Nerbun
*Attorney, Agent, or Firm*—McGlew and Tuttle

[57] ABSTRACT

To embroider combination patterns composed of partial patterns on sewing or embroidering machines with a driven embroidery frame, a common sewing stitch each, which is used as a hooking point, is located outside the contour of the pattern, and whose connection threads to the pattern proper are removed after finishing the second partial pattern, is formed at the end of the first partial pattern and at the beginning of the second partial pattern for the exact positioning of the partial patterns.

8 Claims, 2 Drawing Sheets

PROCESS FOR EMBROIDERING OVERSIZED PATTERNS

FIELD OF THE INVENTION

The present invention pertains to a process for embroidering a combination or desired pattern composed of at least two partial patterns in the correct position on a sewing or embroidering machine where the desired pattern is longer than a travel distance of the embroidering frame and associated drive means.

BACKGROUND OF THE INVENTION

A feed means for an automatic sewing machine, in which a fabric holder can be displaced by means of a displacing mechanism relative to the fabric holder drive between two end positions and can be locked in these positions has been known from DE 31 34 028 C2. The work field of the fabric holders can be doubled through this measure in the direction of movement of the displacing mechanism and it is thus possible to sew a combination pattern composed of two seam sections abutting each other, which is larger than the travel of the fabric holder.

The program-controlled sewing process begins at a starting point located on a center line halving the combination pattern and ends in the first seam section at an intermediate point located on the same center line. When this intermediate point is reached, the sewing process is interrupted by a cam control, a thread-cutting process is performed, and the fabric holder is displaced by the displacing mechanism into its other end position, after which the needle of the sewing machine is located above another intermediate point, which is located on an imaginary line that is located at the end of the travel and no longer intersects the workpiece. The fabric holder is returned from this intermediate point by a cam control to a second seam starting point, beginning from which another seam section, which ends at the end point of the first seam section, is formed in a program-controlled manner. A third seam section is finally formed by the combined cam and program control.

However, this prior-art sewing process for preparing oversized seam patterns requires a fully automated process, i.e., not only the sewing process proper, but also the displacement of the fabric holder into the second end position to the auxiliary points located outside the workpiece must be performed in a program- or cam-controlled manner.

SUMMARY AND OBJECTS OF THE INVENTION

The basic object of the present invention is to develop a process that makes it possible to prepare a combination pattern composed of at least two partial patterns, which is larger than the travel of the embroidery frame, even in the case of normal sewing or embroidering machines equipped with a driven embroidery frame. This object is accomplished by dividing the desired pattern into first and second partial patterns. A hooking point is established for each of the partial patterns, where the hooking point for each partial pattern is at a same location when the first and second partial patterns are combined into the desired pattern. The first partial pattern is sewn with a respective hooking point being formed as a last sewing stitch thereof The workpiece is then moved to receive the second partial pattern from the sewing machine, and to cause the hooking point of the first partial pattern to be located under a needle of the sewing machine. The second partial pattern is sewn with a respective hooking point being formed as a first sewing stitch thereof. Connection threads from the hooking points to the first and second partial patterns are removed after the sewing of the first and second partial patterns. The moving of the workpiece can be done either with the needle in the workpiece or out of the workpiece.

Due to the measure of assigning a common hooking point to be formed by a sewing stitch to two mutually adjacent partial patterns of a combination pattern, it is possible to place the hooking point formed as the last sewing stitch of the first partial pattern exactly under the sewing needle after embroidering the first partial pattern and after displacing the workpiece. Since the hooking point is also the first sewing stitch of the second partial pattern, it is thus ensured that the second partial pattern will be embroidered at the intended distance from the first partial pattern and the combination pattern will thus have the desired appearance.

The displacement of the workpiece, which is to be performed to prepare the second partial pattern, may take place by moving the embroidery frame manually into its respective other end position when an embroidery frame is used that can be displaced relative to the connection member of the embroidery frame drive. However, the displacement of the workpiece may also take place according by reclamping the workpiece in the embroidery frame, especially when patterns of any desired length, e.g., in the form of so-called endless or repetitive edgings, are to be formed by repeatedly lining up individual partial patterns. It is advantageous in this case to assign one hooking point each to each partial pattern at the beginning of the pattern and at the end of the pattern.

When the hooking point is again placed under the needle after the displacement of the workpiece, the comparison between the desired position and the current position of the hooking point in relation to the needle can be performed either by observation of the operator and/or by an optoelectronic means according which generates an optical or acoustic confirmation signal when the desired position of the hooking point is reached.

An alternative process has the relative displacement of the coupling point of the connection member of the embroidery frame drive in relation to the embroidery frame, which is necessary for the displacement of the workpiece from the first embroidering field into the second embroidering field, take place in the opposite manner in this process, i.e., the connection member is displaced relative to the now stationary embroidery frame after the separation of the connection member from the embroidery frame, instead of the embroidery frame being displaced relative to the now stationary connection member. The sewing machine had been stopped before for this purpose with the needle stuck into the workpiece at the hooking point. It is guaranteed as a result that the mutual assignment of the needle and the hooking point is preserved during the displacement of the connection member. Furthermore, the needle also contributes to the fixation of the embroidery frame on the bracket of the sewing machine during the displacement of the connection member. However, it becomes necessary for the operator to additionally hold the embroidery frame with both hands in order to prevent the undesired joint movement of the embroidery frame.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
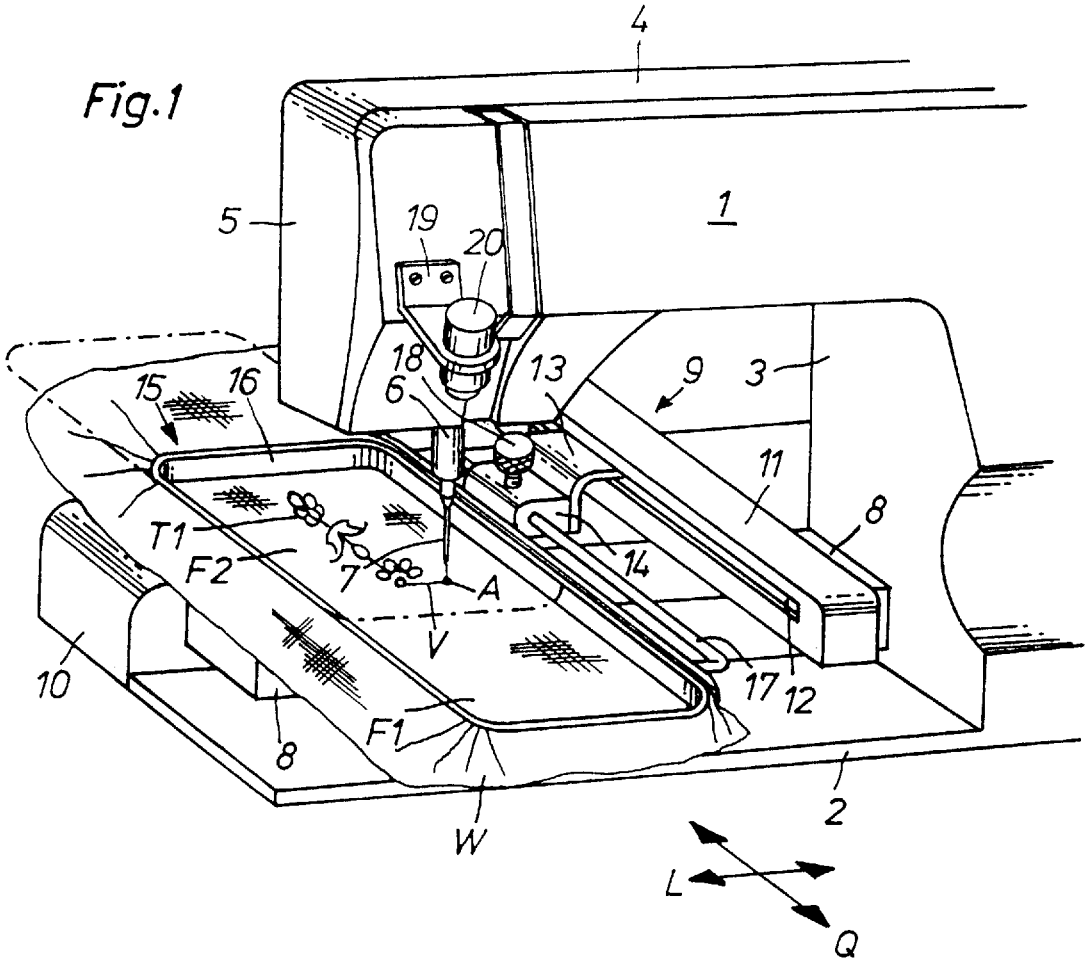
FIG. 1 is a sewing machine equipped with a driven embroidery frame after the formation of a hooking point before the displacement of the embroidery frame.

Of the sewing machine 1 shown in the drawing, only part of the base plate 2, part of the column 3, and part of the arm 4 are shown. The arm 4 ends in a head 5, which carries a needle bar 6 with a sewing needle 7, which needle bar can be moved up and down in the known manner. A horizontally extending bracket 8, which is located at a spaced location from the base plate 2, is arranged at the column 3. As usual, a shuttle or hook, not shown in this case, which cooperates with the thread-carrying sewing needle 7 in the known manner to form a thread seam, is arranged in the bracket 8.

An embroidery unit 9 is detachably fastened at the rear longitudinal side of the bracket 8. The embroidery unit 9 has a housing 10, which extends in the longitudinal direction L and is in contact with the bracket 8, as well as an extension arm 11, which extends in the transverse direction Q at a closely spaced location above the bracket 8 and is displaceable in the longitudinal direction L.

The detailed design and the mode of operation of the embroidery unit are disclosed in DE 295 14 286 U1, so that they do not need to be described here in detail.

A support plate 13 movable to and fro in the transverse direction Q, with an attachment piece 14, which together form a connection member of the embroidery unit 9 for an embroidery frame 15, extends from a passage slot 12 of the extension arm 11. The embroidery frame 15 comprises an inner ring 16 and an outer ring hidden by the workpiece W clamped therein. A longitudinally extending holding clamp 17 is fastened at the outer ring at a spaced location. The holding clamp 17 is mounted displaceably in a hole of the attachment piece 14, not shown in detail, and can be locked by a locking screw 18 in any desired position.

The embroidery frame 15 is a frame of a special size with an embroidering area enlarged in the transverse direction Q, which is divided into a front embroidering field half F1 and a rear embroidering field half F2. The length of the embroidery frame 15 corresponds to twice the travel of the embroidery unit 9 in the transverse direction Q.

Figure 3:
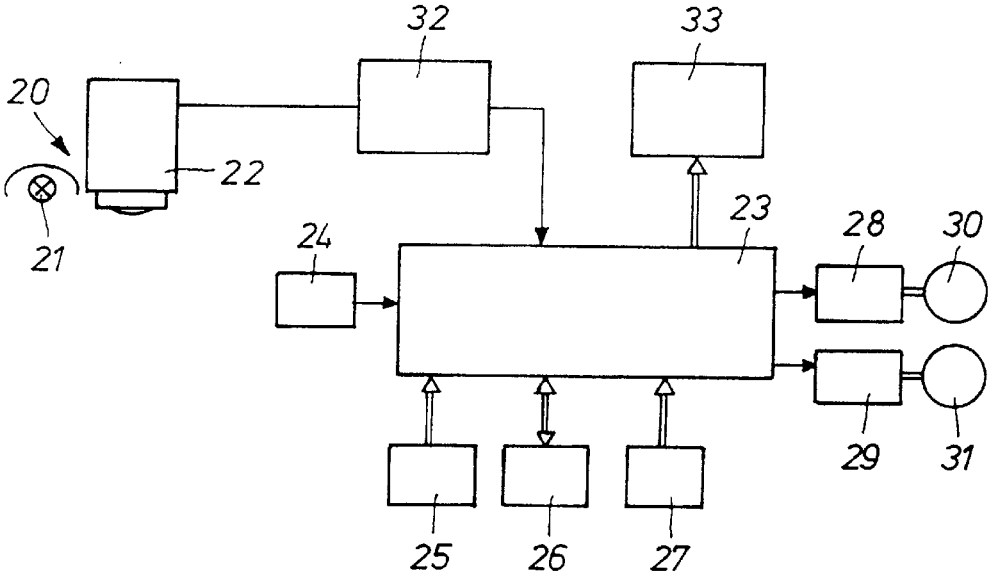
FIG. 3 is a block diagram of the sewing machine control in conjunction with an optoelectronic scanning means for the hooking points.

An L-shaped support 19 for an optoelectronic scanning device 20 is fastened to the head 5. The scanning device 20 comprises, in a manner that is known and is therefore shown only schematically in FIG. 3, a light source 21, whose light beams are directed downward onto the workpiece W, and an image recorder 22 for the light reflected from the workpiece. The illumination and scanning point of the scanning device 20 is directed toward the stitch formation point of the sewing machine 1, i.e., to the point at which the needle 7 is stuck into the workpiece W.

The control for the sewing machine 1 and the embroidery unit 9 contains a microcomputer 23, which is connected, in terms of signals, to the sewing machine drive via a pulse generator 24 driven by the sewing machine. A program memory 25, a working memory 26, and a keyboard 27 are assigned to the microcomputer 23 in a manner that is known and is therefore not explained in more detail. Via stepping motor drivers 28, 29, the microcomputer 23 controls a stepping motor 30 and 31 for the transverse and longitudinal movement of the embroidery frame 15, respectively, as a function of the data of an embroidery pattern that is selected from the program memory 25 and is stored in the working memory 26.

The image recorder 22 is connected to the microcomputer 23 via a prior-art electronic image evaluation unit 32. The result of a scanning process is optically displayed in a display device 33 connected to the microcomputer 23.

Special combination patterns, e.g., combination patterns K composed of two partial patterns T1 and T2, can be prepared with the sewing machine. To satisfactorily position two partial patterns T1, T2 in relation to one another, a common hooking point A, which is preferably located outside the contour of the combination pattern K, is assigned to them, i.e., the hooking point A assigned to the data set of the partial pattern T1 has the same coordinate values as the hooking point A of the partial pattern T2.

Figure 4:
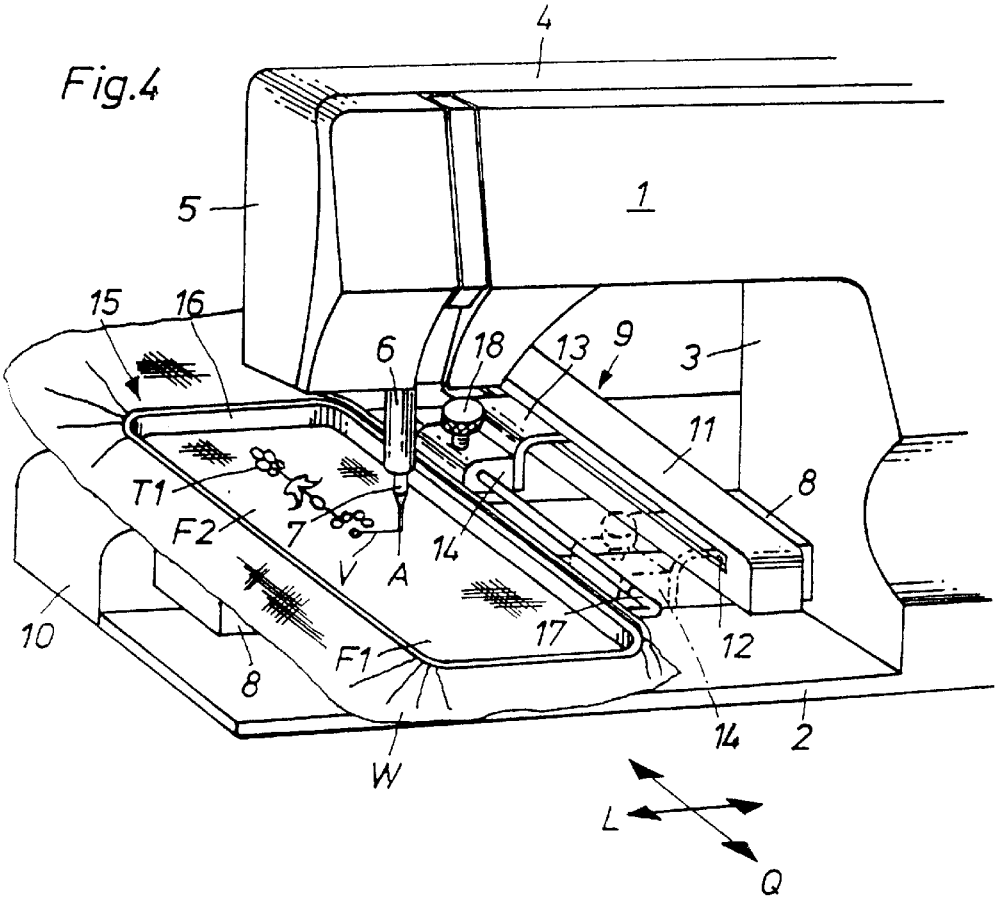
FIG. 4 is a sewing machine according to FIG. 1 with the needle stuck in before the alternative process is carried out.

FIGS. 1 and 4 now show the situation in which the partial pattern T1 of a combination pattern K composed of two partial patterns T1 and T2 has been embroidered on the section of the workpiece located at the rear embroidering field half F2. Besides the complete partial pattern T1, the hooking point A located outside the contour of the partial pattern T1 was formed as another additional sewing stitch beginning from the last sewing stitch of the partial pattern T1. Its connection thread V extending to the last sewing stitch of the partial pattern T1 proper is not part of the partial pattern T1.

In the process according to the first exemplary embodiment, the sewing machine is stopped after sewing the hooking point A, after which the operator cuts the sewing thread leading to the corresponding thread reserve. The operator then loosens the locking screw 18 and displaces the embroidery frame 15 relative to the stationary attachment piece 14 into the position indicated by dash-dotted line in FIG. 1, so that the front embroidering field half F1 is now in the embroidering area of the sewing machine 1.

After the locking screw 18 has been tightened again, the embroidery frame 15 is moved back, e.g., by actuating moving buttons, not shown, which directly affect the control of the stepping motor 30 for the transverse movement of the embroidery frame 15, to the extent that the hooking point A will again be located under the needle 7.

The comparison between the desired position and the actual position of the hooking point A in relation to the needle 7, which comparison is to be performed now, is carried out by means of the scanning device 20. The light that is sent from the light source 21 to the scanning point and is reflected by same is received by the image recorder 22 and is analyzed by the electronic image evaluation unit 32 to determine whether the hooking point A is located under the needle 7. If it is, the microcomputer 23 generates a confirmation signal, which is made visible on the display device 33. This confirmation signal may also be used to stop the stepping motor 30 switched on for the transverse displacement of the embroidery frame 15.

If the confirmation signal is also used to switch off the stepping motor 30, the accuracy of alignment can be improved without additional technical effort by moving forward the scanning point of the scanning device 20 by such an amount in front of the stitch formation point that corresponds to the braking travel or the reaction time of the stepping motor 30 after the switch-off command is sent to it. To improve the recognizability of the hooking point A, it may, furthermore, be advantageous for the hooking point A to be designed as an optically concise marking pattern, e.g., in the form of a crosshair.

Figure 2:
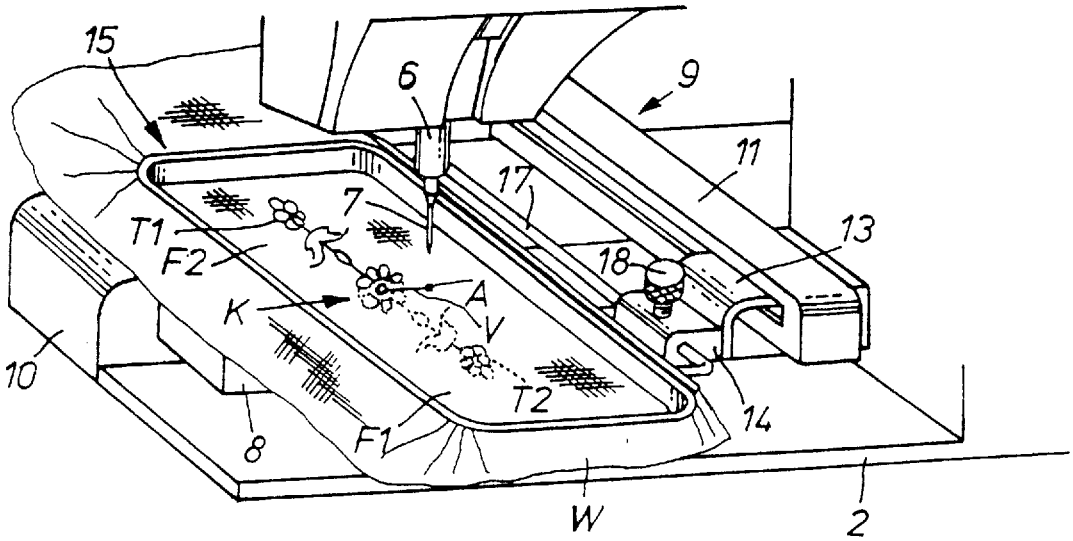
FIG. 2 is the sewing machine after the displacement of the embroidery frame before the beginning of the embroidering of the second partial pattern.

At the beginning of the second partial pattern T2, the first sewing stitch of the partial pattern T2, which is also used as a hooking point A, is first formed at the site of the already existing hooking point A, and the partial pattern T2 proper, which is shown by broken line in FIG. 2, is embroidered thereafter. If the hooking points A of the two partial patterns T1 and T2 coincide, it is guaranteed that the distance between the two partial patterns T1 and T2, which is to be measured in the transverse direction, will exactly correspond to the intended measure and that the combination pattern K will thus also have exactly the desired appearance. Whether the partial patterns T1 and T2 shall overlap, touch each other or be located at mutually spaced locations from one another is irrelevant. An accurate positioning of the partial patterns T1 and T2 can always be achieved by the hooking points A.

After completing the partial pattern T2, the connecting threads V, which extend to the hooking points A, which are no longer needed now, are cut out.

The partial patterns intended for forming endless or repetitive patterns, the so-called endless edgings, have a hooking point A both at the beginning and the end of the pattern. Since such patterns are often much longer than even the embroidery frame 15 enlarged to double length, and the workpiece must be reclamped in the embroidery frame 15 once or several times, depending on the length of the entire pattern. The hooking points help achieve the desired positioning of the partial patterns precisely in such cases.

In the process according to the second exemplary embodiment, the sewing machine is stopped with the needle 7 stuck in at the hooking point after sewing the hooking point A. The operator then loosens the locking screw 18, holds the embroidery frame 15 with one hand, and starts the stepping motor 30 for the transverse movement by actuating a corresponding button, not shown, with the other hand. The attachment piece 14 is now displaced relative to the fixed embroidery frame 15 along the holding clamp 17 from the rear position shown in FIG. 4 into the front position indicated by dash-dotted line, which corresponds to the pattern start position of the second partial pattern T2. The operator then tightens the locking screw 18 again and thus again connects the embroidery frame 15 to the drive of the embroidering unit 9. As soon as this has been done, the second partial pattern T2 can be embroidered as in the first exemplary embodiment.

While specific embodiments of the invention have been shown and described in detail to illustrate the application of the principles of the invention, it will be understood that the invention may be embodied otherwise without departing from such principles.

What is claimed is:

1. A process for embroidering a desired pattern on a workpiece by a sewing machine with a driven embroidery frame having a travel distance shorter than the desired pattern, the process comprising the steps of:

dividing the desired pattern into first and second partial patterns;

establishing a hooking point for each of said partial patterns, said hooking point for each said partial pattern being at a same location when said first and second partial patterns are combined into the desired pattern;

sewing said first partial pattern with a respective said hooking point being formed as a last sewing stitch of said sewing of said first partial pattern;

moving the workpiece to receive said second partial pattern from the sewing machine, and to cause said hooking point of said first partial pattern to be located under a needle of the sewing machine;

sewing said second partial pattern with a respective said hooking point being formed as a first sewing stitch of said sewing of said second partial pattern; and removing connection threads from said hooking points to said first and second partial patterns after said sewing of said first and second partial patterns.

2. A process in accordance with claim 1, wherein:

said hooking points are located outside the desired pattern.

3. A process in accordance with claim 1, wherein:

said driven embroidery frame has a connection member displaceable in relation to a drive of said driven embroidery frame;

said moving of the workpiece to receive said second partial pattern is performed by manually displacing the embroidery frame in relation to said connection member.

4. A process in accordance with claim 1, wherein:

said moving of the workpiece to receive said second partial pattern is performed by reclamping the workpiece.

5. A process in accordance with claim 1, wherein:

the desired pattern is a repetitive pattern;

said dividing of the desired pattern is into a plurality of said partial patterns;

each of said plurality of partial patterns includes one of said hooking points at a beginning and end of a respective said partial pattern to cause a hooking point at the end of said each partial pattern to be in a same location as a hooking point at a beginning of a next said partial pattern.

6. A process in accordance with claim 4, wherein:

the desired pattern is a repetitive pattern;

said dividing of the desired pattern is into a plurality of said partial patterns;

each of said plurality of partial patterns includes one of said hooking points at a beginning and end of a respective said partial pattern to cause a hooking point at the end of said each partial pattern to be in a same location as a hooking point at a beginning of a next said partial pattern.

7. A sewing machine for embroidering a desired pattern on a workpiece, the machine comprising:

an embroidery frame;

drive means for moving said embroidery frame a travel distance;

a connection means displaceably connecting said embroidery frame to said drive means with respect to said travel distance;

an optical sensor with a scanning point directed toward a stitch formation point of the sewing machine;

an electronic evaluating unit for controlling the sewing machine and said drive means to sew a first partial pattern of the desired pattern with a hooking point, said evaluating unit receiving information from said optical sensor for aligning said hooking point of said first partial pattern with a hooking point of a second partial pattern after said connection means has repositioned said embroidery frame with respect to said drive means; and a display device connected to said evaluating unit.

8. A process for embroidering a desired pattern on a workpiece by a sewing machine with a driven embroidery frame having a travel distance shorter than the desired pattern, the process comprising the steps of:

dividing the desired pattern into first and second partial patterns;

establishing a hooking point for each of said partial patterns, said hooking point for each said partial pattern being at a same location when said first and second partial patterns are combined into the desired pattern;

providing drive means for moving said embroidery frame with respect to a needle of the sewing machine for sewing of said partial patterns;

sewing said first partial pattern with a respective said hooking point being formed as a last sewing stitch of said sewing of said first partial pattern;

detaching the embroidery frame from said drive means and moving the embroidery frame to position the workpiece to receive said second partial pattern from the sewing machine while a needle of the sewing machine is still positioned in the workpiece at said hooking point;

reconnecting the embroidery frame to said drive means after the workpiece is positioned to receive said second partial pattern;

sewing said second partial pattern with a respective said hooking point being formed as a first sewing stitch of said sewing of said second partial pattern; and removing connection threads from said hooking points to said first and second partial patterns after said sewing of said first and second partial patterns.

* * * * *